US006865763B2

(12) United States Patent
Sears

(10) Patent No.: US 6,865,763 B2
(45) Date of Patent: Mar. 15, 2005

(54) CLUTCH FOR WASHING MACHINE AND METHOD FOR USING SAME

(75) Inventor: Jeffrey L. Sears, Grinnell, IA (US)

(73) Assignee: Maytag Corporation, Newton, IA (US)

( * ) Notice: Subject to any disclaimer, the term of this patent is extended or adjusted under 35 U.S.C. 154(b) by 424 days.

(21) Appl. No.: 10/058,745

(22) Filed: Jan. 23, 2002

(65) Prior Publication Data

US 2003/0135933 A1 Jul. 24, 2003

(51) Int. Cl.[7] ..... D06F 37/30; F16D 11/00

(52) U.S. Cl. ..... 8/159; 68/12.24; 192/105 BA; 192/105 CD

(58) Field of Search ..... 8/158, 159; 68/12.24, 68/23.6, 23.7, 133; 192/54.1, 54.5, 105 BA, 105 CD

(56) References Cited

U.S. PATENT DOCUMENTS 2,639,618 A 5/1953 McNairy
2,869,344 A * 1/1959 Bochan ..... 192/105 BA
3,199,649 A 8/1965 Bochan et al.
3,693,771 A * 9/1972 De Lancey ..... 192/105 CD
3,718,214 A 2/1973 Newman
3,838,755 A 10/1974 Cochran et al.
3,945,478 A 3/1976 Kellerman et al.
4,231,237 A 11/1980 Bochan
4,719,769 A 1/1988 Pielemeier et al.
5,491,859 A 2/1996 Richardson
5,503,261 A * 4/1996 Schultz ..... 192/105 CD
5,605,212 A 2/1997 Hauser
5,651,277 A 7/1997 Richardson
6,244,078 B1 6/2001 Thompson et al.
6,247,570 B1 * 6/2001 Zindler ..... 192/105 BA

* cited by examiner

*Primary Examiner*—Frankie L. Stinson
*Assistant Examiner*—Joseph Perrin
(74) *Attorney, Agent, or Firm*—McKee, Voorhees & Sease, P.L.C.

(57) ABSTRACT

A clutch for washing machine includes a rotating hub driven by a motor. The hub engages a rotatable intermediate plate which is mounted in spaced relationship inside an annular hub. As the rotational speed of the intermediate plate increases it expands radially outwardly and engages the hub to complete the clutch engagement.

13 Claims, 3 Drawing Sheets

CLUTCH FOR WASHING MACHINE AND METHOD FOR USING SAME

BACKGROUND OF THE INVENTION

The present invention relates to a clutch for washing machine and method for using same.

Vertical axis washers include a perforated spinner basket having an agitator therein. These washers have an agitation mode which causes the agitator to reciprocate back and forth in opposite rotational directions. These washers also include a spin cycle wherein the spinner basket is rotated at high speeds to cause the materials therein to be spun out by centrifugal force.

When a vertical axis washer goes into the spin portion of its cycle, the spinner basket full of wet clothes is far too heavy for the drive motor to ramp up to speed quickly. Prior art methods for handling this ramping up involve the use of a loose or slipping belt between the motor and the spinner basket. This allows the motor to ramp up to full speed and slowly bring the spinner basket full of clothes up to speed.

Other methods for handling this problem include slip clutches having an outer housing that is belted to the spinner basket and an inner hub that is keyed to the motor with weights that are centrifugally applied to the outer hub to accelerate the spinner gradually. These clutches include a center hub that is ramped on one side to give it a positive drive in that direction for agitation and a radial side for a slip-clutch feature in the opposite direction for spinning.

Therefore a primary object of the present invention is the provision of an improved clutch for washing machine and method for using same.

A further object of the present invention is the provision of an improved clutch which has no springs or weights.

A further object of the present invention is the provision of a clutch for a washing machine having a metal plate that flexes outwardly in response to centrifugal force and engages an annular hub.

A further object of the present invention is the provision of an improved clutch which gradually engages two rotating members to permit a gradual ramp up to full speed for the spinner basket.

A further object of the spinner basket is the provision of an improved clutch and method for using same, which is economical to manufacture, durable in use, and efficient in operation.

BRIEF SUMMARY OF THE INVENTION

The foregoing objects may be achieved by a washing appliance clutch for transferring rotational power from a motor to a driven basket for rotating the driven basket about a drive axis. The washing appliance clutch comprises a drive member adapted to be driven by the motor for rotation about the drive axis. An intermediate plate is engaged by the drive member for rotation with the drive member about the drive axis. The intermediate plate includes an outer peripheral edge and a hub surrounds the outer peripheral edge of the intermediate plate in close spaced relation thereto. The outer peripheral edge of the intermediate plate is capable of flexing in response to centrifugal force during the rotation of the intermediate plate from a retracted position free from engagement with the hub to an expanded position engaging the hub and rotating the hub about the drive axis.

According to a further feature of the invention the intermediate plate includes a plurality of cutout portions that create a plurality of weakened points in the intermediate plate. The weakened points in the intermediate plate permit flexing of the intermediate plate in response to centrifugal force during rotation.

According to another feature of the present invention the intermediate plate includes a first group of cutout portions that comprise slots extending from the outer peripheral edge inwardly towards the drive axis.

According to another feature of the invention a second group of cutout portions are located completely inwardly from the peripheral edge of the intermediate plate.

According to a further feature of the invention the drive member includes a first cam surface and the intermediate plate includes a first cam follower surface engaging the first cam surface of the drive member. The motor includes an agitate mode in which it drives the drive member continuously in a first rotational direction. The motor also includes a spin mode in which it drives the drive member continuously in a second rotational direction opposite from the first rotational direction.

The first cam surface and the first cam follower surface cooperate to cause the outer peripheral edge of the intermediate plate to move from the retracted to the expanded position during rotation of the drive member in the agitate mode.

According to another feature of the invention the outer peripheral edge of the intermediate plate flexes from the retracted to the expanded position solely in response to centrifugal force during rotation of the intermediate plate when the motor is in the spin mode.

According to another feature of the invention a high friction material is positioned between the outer peripheral edge of the intermediate plate and the hub for facilitating frictional engagement between the hub and the outer peripheral edge of the intermediate plate.

The foregoing objects may also be achieved by the method of the present invention. The method includes connecting the motor to a drive member. The drive member is then placed in driving connection with an intermediate plate so that the rotation of the drive member will cause rotation of the intermediate plate. The intermediate plate includes an expandable outer peripheral edge. The method further includes surrounding the peripheral edge of the intermediate plate with an annular hub connected to the washing appliance basket. The motor is activated to rotate the drive member and cause rotation of the intermediate plate whereby the outer peripheral edge of the intermediate plate will flex in response to centrifugal force from a retracted position spaced in an inner radial direction from the annular hub to an expanded position frictionally engaging and rotating the hub.

DETAILED DESCRIPTION OF THE INVENTION

Figure 1:
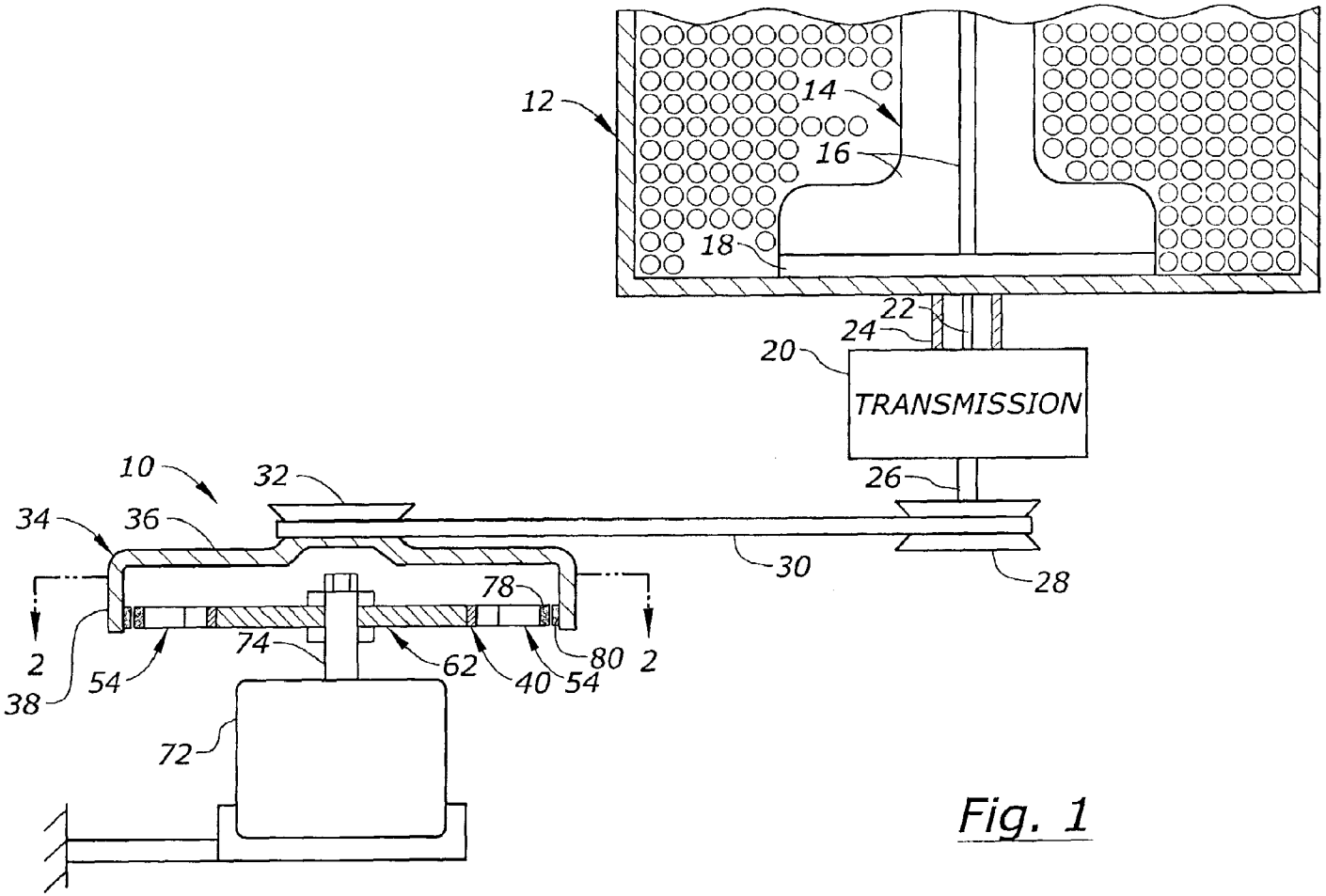
FIG. 1 is a schematic drawing showing the clutch in section taken along line 1—1 of FIG. 2 and showing the clutch connected to a washing basket and agitator.

The numeral 10 generally designates the clutch of the present invention. The clutch shown drivingly connected to a spinner basket 12 for rotating the spinner basket 12. Alternatively the clutch is capable of driving an agitator 14 within the spinner basket 12. The agitator 14 includes agitator fins or paddles 16 and an agitator base 18.

A transmission 20 includes an agitator drive shaft 22 and a spinner drive shaft 24. The transmission 20 includes an input shaft 26 having a pulley 28 thereon. The rotation of the pulley 28 in a first rotational direction will cause the transmission 20 to alternatively rotate the agitator 14 in first and second opposite rotational directions so as to create an agitation action within the spinner basket 12. This alternative agitating motion is transferred from the transmission 20 through the shaft 22 to the agitator 14.

When the pulley 28 is rotated in an opposite second direction the transmission 20 transfers rotational movement through the spinner drive shaft 24 to the spinner basket 12 and causes rotation of the spinner basket 12 only in the second direction. This rotation is usually at high speeds so as to centrifugally spin the washing fluid out of the fabrics that are within the spinner basket 12.

Connected to the pulley 28 is a drive belt 30 which is also trained around a pulley 32 fixed to a clutch hub 34 for rotation in unison therewith. The clutch hub 34 includes a circular end wall 36 and an angular flange 38.

Figure 3:
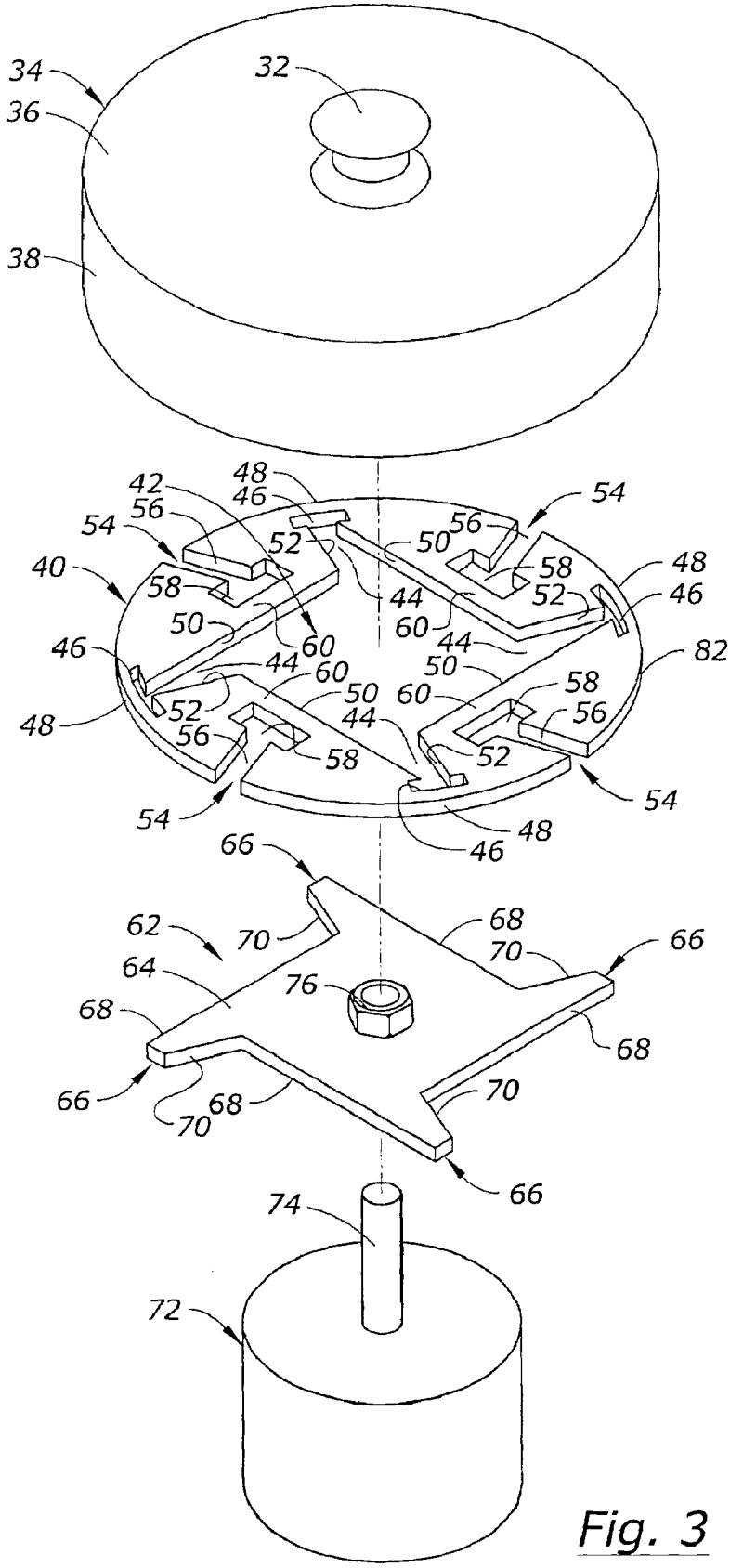
FIG. 3 is an exploded perspective view of the clutch mechanism of the present invention.

Inside the clutch hub 34 is a circular intermediate plate 40 having a central cutout portion 42 shown in FIG. 3.

The cutout portion 42 includes four cutout spokes 44 and four arcuate T-slots 46 at the outer ends of the cutout spokes 44. The arcuate T-slots 46 are very close to the outer peripheral edge 82 of the intermediate plate 40. This close proximity creates four outer weak spots 48 that are capable of flexing in response to centrifugal force resulting from rotation of the intermediate plate 40. Each of the cutout spokes 44 in the intermediate plate 40 include an orthogonal side 50 and an angled side or cam surface 52. The four orthogonal sides 50 are perpendicular to one another and form a generally rectangle shape. The four angled sides 52 are angled with respect to the orthogonal sides at an angle of approximately 30°. However, the angle may be varied without detracting from the invention.

Figure 2:
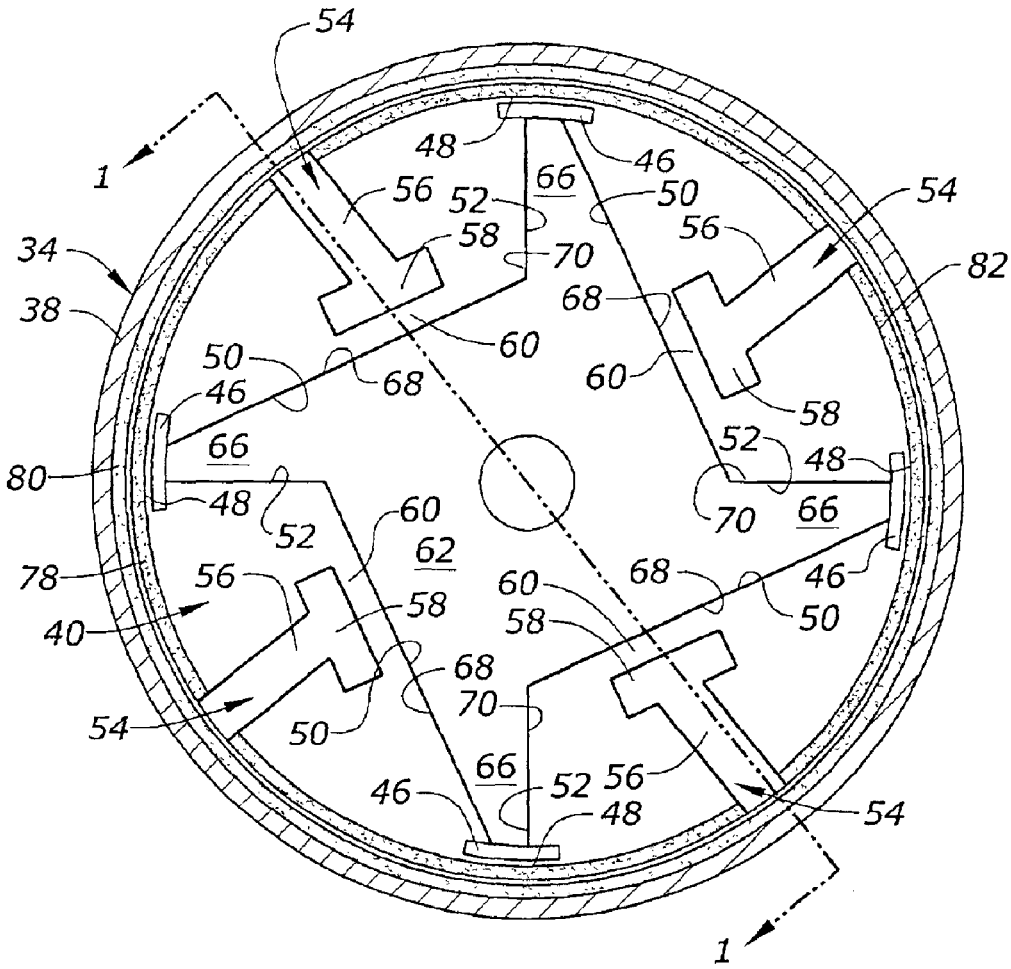
FIG. 2 is a sectional view taken along line 2—2 of FIG. 1.

Extending inwardly from the outer peripheral edge 82 of the intermediate plate 40 are four outside T-slots 54 each of which comprise a T-leg 56 and a T-cross 58. As can be seen in FIG. 2 the T-leg 56 is at a slight angle with respect to the T-cross 58. This angle may be varied without detracting form the invention. The T-crosses 58 are very close to the orthogonal sides 50 of the central cutout 42, and because of this close proximity they create inner weak spots 60 which are capable of flexing in response to centrifugal force of the intermediate plate 40 when it rotates.

A drive member 62 fits within the cutout 42 and includes a square hub 64 having four spokes 66 extending outwardly from its four corners. Each spoke includes an orthogonal surface 68 and an angled or cam follower surface 70. The drive member 62 is mounted for rotation on an output shaft 74 extending from a motor 72. The motor 72 is reversible and is capable of driving the drive member 62 either in a clockwise or a counter clockwise direction. Shaft 74 is attached to the drive member 62 by means of a nut 76. Extending around the outer peripheral edge 82 of the intermediate plate 40 is a frictional ring 78, and extending around the interior of the annular flange 38 of hub 34 is a similar friction ring 80. While two friction rings 78, 80 are shown in the drawings, it is possible to have just one friction ring, either mounted on the outer edge of the intermediate plate 40 or alternatively a single friction ring mounted on the inside surface of the annular flange 38 of hub 34.

In operation the motor 72 is actuated to drive the drive member 68 in an agitation mode. As viewed in FIG. 2 this agitation mode would rotate the drive member 62 in a clockwise direction. This causes the orthogonal surface 68 of the drive member 62 to cam against the orthogonal side 50 of the intermediate plate 40. The camming action results in the intermediate plate 40 being deflected radially outwardly so that its outer peripheral edge 82 forces the frictional rings 78, 80 into contact with one another. The outer weak points 48 and the inner weak points 60 flex in order to permit this outward radial expansion. The rotational movement is then transferred because of the frictional engagement between the two frictional rings 78, 80 to the hub 34 and then through belt 30 to the transmission 20. The transmission responds to this driving movement by rotating the agitator 14 alternatively first in one direction and then in the opposite direction.

When the spin cycle is reached in the cycle of the washing machine, the motor 72 is reversed to rotate the drive member in a counter clockwise direction as viewed in FIG. 2. Initially the rotation of the intermediate member 40 does not result in expansion, but as the rotational velocity increases, centrifugal force causes the intermediate member 40 to bend at the weak points 48, 60 and expand radially outwardly. Ultimately the frictional members 78, 80 come into contact with one another and they initially slip slightly. This permits some slippage between the rings 78, 80 as the ramp up speed is achieved thereby causing a gradual shift of driving force to the transmission 20 and ultimately to the spinner basket 12. This gradual application of force is important because of the heavy load of wet fabrics that is often contained within the washing basket 12. As the rotational speed of drive member 62 increases the expansion of the intermediate plate 62 also increases until there is tight frictional engagement between the rings 78, 80 thereby completing the driving and spinning action to the spinner basket 12.

The clutch shown in the drawings includes no springs or weights to be held in place to control the rate of acceleration. Instead the gradual engagement of the clutch occurs as the centrifugal force increases during the increasing of rotation of the drive member 62.

While orthogonal surfaces 50, 68 are shown to be straight, it is also possible to curve one or both of those surfaces to ensure a positive drive condition.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A method for transferring rotational movement from a motor to a washing appliance basket mounted within a washing appliance for rotation about a drive axis, the method comprising:

connecting the motor to a drive member, the drive member having a first cam surface;

mounting an intermediate member having a first cam follower surface for rotation relative to the drive member;

rotating the drive member to cause the first cam surface to engage the first cam follower surface on the intermediate plate to cause the intermediate plate to rotate, the intermediate plate having an expandable outer peripheral edge;

surrounding the outer peripheral edge of the intermediate plate with an annular hub connected to rotate the washing appliance basket, whereby the outer peripheral edge of the intermediate plate will flex in response to centrifugal force from a retracted position spaced in an inner radial direction from the annular hub to an expanded position frictionally engaging and rotating the hub; and connecting the rotating hub to the washing appliance basket for rotating the washing appliance basket.

2. A method according to claim 1 wherein the rotation of the drive member by the motor is in a first rotational direction, the motor being reversible to cause rotation of the drive member in a second rotational direction opposite from the first rotational direction.

3. A method according to claim 1 wherein the motor is capable of operating in an agitation mode to rotate the drive member in a first rotational direction, and the motor is capable of operating in a spin mode to rotate the drive member continuously only in the second rotational direction.

4. A method according to claim 1 wherein activating the motor to rotate the drive member in an agitation mode in a first rotational direction causes rotation of the intermediate plate; the method further comprising flexing the outer peripheral edge of the intermediate plate from the retracted to the expanded position by cooperating the first cam surface of the drive member with the first cam follower surface of the intermediate plate.

5. A method according to claim 4 wherein activating the motor to rotate the drive member in a spin mode in a second rotational direction causes rotation of the intermediate plate; the method further comprising flexing the outer peripheral edge of the intermediate plate from the retracted to the expanded position solely using centrifugal force during rotation of the intermediate plate.

6. A washing appliance clutch for transferring rotational power from a motor to a driven basket for rotating the driven basket about a basket axis, the washing appliance clutch comprising:

a drive member adapted to be driven by the motor for rotation about a drive axis;

a drive member comprising a first cam surface;

an intermediate plate engaged by the drive member for rotation with the drive member about the drive axis;

the intermediate plate comprising an outer peripheral edge;

a plurality of cutout portions that create a plurality of weakened points in the intermediate plate, the weakened points in the intermediate plate permitting flexing of the intermediate plate in response to centrifugal force during rotation of the intermediate plate;

a first group of the cutout portions comprising slots extending from the outer peripheral edge inwardly toward the drive axis;

a second group of the cutout portions located completely inwardly from the peripheral edge of the intermediate plate;

a first cam follower surface engaging the first cam surface of the drive member;

a hub surrounding the outer peripheral edge of the intermediate plate in close spaced relation thereto;

the outer peripheral edge of the intermediate plate being capable of flexing in response to centrifugal force during rotation of the intermediate plate from a retracted position free from engagement with the hub to an expanded position engaging the hub and rotating the hub about the drive axis.

7. A washing appliance clutch according to claim 6 wherein the motor includes an agitation mode in which it drives the drive member in a first rotational direction, the motor including a spin mode in which it drives the drive member in a second rotational direction.

8. A washing appliance clutch according to claim 7 wherein the first cam surface and the first cam follower surface cooperate to flex the outer peripheral edge of the intermediate plate from the retracted to the expanded position during rotation of the drive member in the first rotational direction when the motor is in the agitation mode.

9. A washing appliance clutch according to claim 8 wherein the outer peripheral edge of the intermediate plate flexes from the retracted to the expanded position solely in response to centrifugal force during rotation of the intermediate plate when the motor is in the spin mode.

10. A washing appliance clutch according to claim 6 and further comprising a high friction material positioned on the outer peripheral edge of the intermediate plate and on the hub for facilitating frictional engagement between the hub and the outer peripheral edge of the intermediate plate during rotation of the intermediate plate.

11. In combination:

a washing appliance having a basket mounted for rotation about a drive axis;

a motor capable of imparting rotational power;

a drive member driven by the motor for rotation about the drive axis;

the drive member having a first cam surface;

an intermediate plate having a first cam follower surface engaging the first cam surface of the drive member for rotation with the drive member about the drive axis;

the intermediate plate having an outer peripheral edge;

a hub surrounding the outer peripheral edge of the intermediate plate and being attached to the basket;

the outer peripheral edge of the intermediate plate being capable of flexing in response to centrifugal force during rotation of the intermediate plate from a retracted position free from engagement with the hub to an expanded position engaging the hub and rotating the hub about the drive axis.

12. The combination according to claim 11 wherein the outer peripheral edge of the intermediate plate is capable of flexing from the retracted position to the expanded position in response to cooperation between the first cam surface and the first cam follower surface during rotation of the intermediate plate in a first rotational direction.

13. The combination according to claim 12 wherein the outer peripheral edge of the intermediate plate is capable of flexing from the retracted position to the expanded position solely in response to centrifugal force during rotation of the intermediate plate in a second rotational direction.

* * * * *